US006681833B2

(12) United States Patent
Wylie

(10) Patent No.: US 6,681,833 B2
(45) Date of Patent: Jan. 27, 2004

(54) SCREEN FRAME HAVING CORNERS UNDER COMPRESSION

(75) Inventor: Douglas H. Wylie, Richmond Hill (CA)

(73) Assignee: Saint-Gobain Bayform America, Inc., Cadiz, OH (US)

( * ) Notice: Subject to any disclaimer, the term of this patent is extended or adjusted under 35 U.S.C. 154(b) by 0 days.

(21) Appl. No.: 10/128,667

(22) Filed: Apr. 23, 2002

(65) Prior Publication Data

US 2003/0196770 A1 Oct. 23, 2003

(51) Int. Cl.[7] ..... A47G 5/00

(52) U.S. Cl. ..... 160/381; 160/377; 52/656.7; 29/897.312

(58) Field of Search ..... 160/369, 371, 160/376, 377, 380, 381; 52/656.7, 656.5; 29/897.312, 897, 453

(56) References Cited

U.S. PATENT DOCUMENTS

| | | | | | |
|---|---|---|---|---|---|
| 3,097,684 | A | | 7/1963 | Le Tarte | 153/2 |
| 4,096,308 | A | * | 6/1978 | Reed | 428/247 |
| 4,255,992 | A | | 3/1981 | Bolles | 83/23 |
| 4,411,183 | A | | 10/1983 | Auer | 83/581 |
| 4,590,779 | A | | 5/1986 | Stange et al. | 72/294 |
| 5,115,584 | A | * | 5/1992 | Lucchetti | 38/102.91 |
| 5,231,862 | A | | 8/1993 | Ashley | 72/332 |
| 5,365,813 | A | | 11/1994 | Greene | 83/35 |
| 5,881,525 | A | | 3/1999 | Riegelman et al. | 52/656.7 |
| 6,109,331 | A | | 8/2000 | Story, Jr. | 160/371 |
| 6,250,241 | B1 | * | 6/2001 | Spengler | 114/102.11 |
| 6,331,223 | B1 | * | 12/2001 | Wylie et al. | 156/160 |
| 6,390,173 | B1 | * | 5/2002 | Story, Jr. | 160/371 |
| 6,406,509 | B1 | * | 6/2002 | Duffy | 55/492 |

FOREIGN PATENT DOCUMENTS

| | | | | |
|---|---|---|---|---|
| FR | 2674357 | * | 9/1992 | 160/381 X |

* cited by examiner

*Primary Examiner*—Bruce A. Lev
(74) *Attorney, Agent, or Firm*—Duane Morris LLP; Steven E. Koffs

(57) ABSTRACT

A frame for a ventilation screen-frame assembly includes a body having a mounting surface for receiving ventilation screen material. In one example, the body has at least three V-shaped cuts partially through it. Each V-shaped cut leaves an edge of the body uncut. The body is folded about each uncut edge so that the ends of the body meet at a corner. Each V-shaped cut subtends an angle θ that is slightly less than 90 degrees, so that the folded corners are in compression. The assembly further includes a single corner key for joining the ends of the body into a closed frame. A reinforcement clip can be used in each folded corner.

32 Claims, 7 Drawing Sheets

SCREEN FRAME HAVING CORNERS UNDER COMPRESSION

FIELD OF THE INVENTION

The present invention relates to building materials generally, and more specifically to frames suitable for use in ventilation screen assemblies.

BACKGROUND OF THE INVENTION

Ventilation screen frame assemblies are well known. Joining four sections of roll-formed or extruded screen bar material, using four corner keys to attach each pair of consecutive frame members forms a typical frame.

U.S. Pat. No. 3,097,684 to Le Tarte shows an alternative method of forming a screen frame using a single elongated piece of screen bar stock. Four V-shaped cuts are cut partially through the body, each V-shaped cut leaving an edge of the body uncut. Each V-shaped cut subtends an angle of 90 degrees. The body is folded about each uncut edge so that the ends of the body meet along one side of the frame. The ends of the body are joined to form a closed frame.

A method of forming a stronger frame is desired.

SUMMARY OF THE INVENTION

One aspect of the present invention is a frame for a ventilation screen-frame assembly. The assembly includes a body having a mounting surface for receiving ventilation screen material. The body has one or more V-shaped cuts partially through it. Each V-shaped cut leaves an edge of the body uncut. The body is folded about each uncut edge so that the ends of the body meet. Each V-shaped cut subtends an angle θ that is slightly less than 90 degrees, so that the folded corners are in compression. The assembly further includes means for joining the ends of the body into a closed frame.

Another aspect of the invention is a method for forming a frame for a ventilation screen-frame assembly. A body is provided having a mounting surface for receiving ventilation screen material. At least three V-shaped cuts are cut partially through the body, each V-shaped cut leaving an edge of the body uncut. Each V-shaped cut subtends an angle θ that is slightly less than 90 degrees. The body is folded about each uncut edge so that the ends of the body meet, so that the folded corners are in compression. The ends of the body are joined to form a closed frame.

Another aspect of the invention is a method for forming a ventilation screen-frame assembly, comprising the steps of: forming a body having a mounting surface for receiving ventilation screen material; heating the body; inserting a hot melt adhesive in a groove of the body; cutting at least three V-shaped cuts partially through the body, each V-shaped cut leaving an edge of the body uncut; folding the body about each uncut edge so that the ends of the body meet; joining the ends of the body to form a closed frame; transferring the frame directly to an insertion apparatus without cooling the frame; and inserting screen cloth into the hot melt adhesive.

Yet another aspect of the invention is a frame for a ventilation screen-frame assembly, comprising: a pair of elongate bodies, each having a mounting surface for receiving ventilation screen material. Each body has a V-shaped cut partially therethrough. Each V-shaped cut leaves an edge of the body uncut. The bodies are folded about each uncut edge so that each V-shaped cut subtends an angle θ that is slightly less than 90 degrees, and the folded corners are in compression. The two bodies are arranged so as to form a four sided frame with the ends of the bodies meeting at corners of the bodies. Means are provided for joining the ends of the bodies into a closed frame.

Another aspect of the invention is a ventilation screen-frame assembly, comprising a body having a mounting surface for receiving ventilation screen material. The body has at least three V-shaped cuts partially therethrough. Each V-shaped cut leaves an edge of the body uncut. The body is folded about each uncut edge so that the ends of the body meet. The body has a radius of curvature of about 50 meters while the body is in an unstressed state. Means are provided for joining the ends of the body into a closed frame. Ventilation screen cloth is tensioned by and mounted to the frame, so that the sides of the frame are held substantially straight by the screen cloth, and the body is in compression at each folded corner.

These and other aspects of the invention are described below with reference to the drawings and the exemplary embodiments.

DETAILED DESCRIPTION

U.S. patent application Ser. No. 09/997,737, filed Dec. 24, 1997 (now U.S. Pat. No. 6,279,644, issued Aug. 28, 2001) and Ser. No. 09/379,102 filed Aug. 23, 1999 (now U.S. Pat. No. 6,331,223, dated Dec. 18, 2001) and PCT International Application No. PCT/IB00/01716, filed Aug. 23, 2000, and U.S. Provisional Patent Application No. 60/272,334, Filed Feb. 28, 2001 are incorporated by reference herein in their entireties, as though set forth fully herein.

Figure 4:
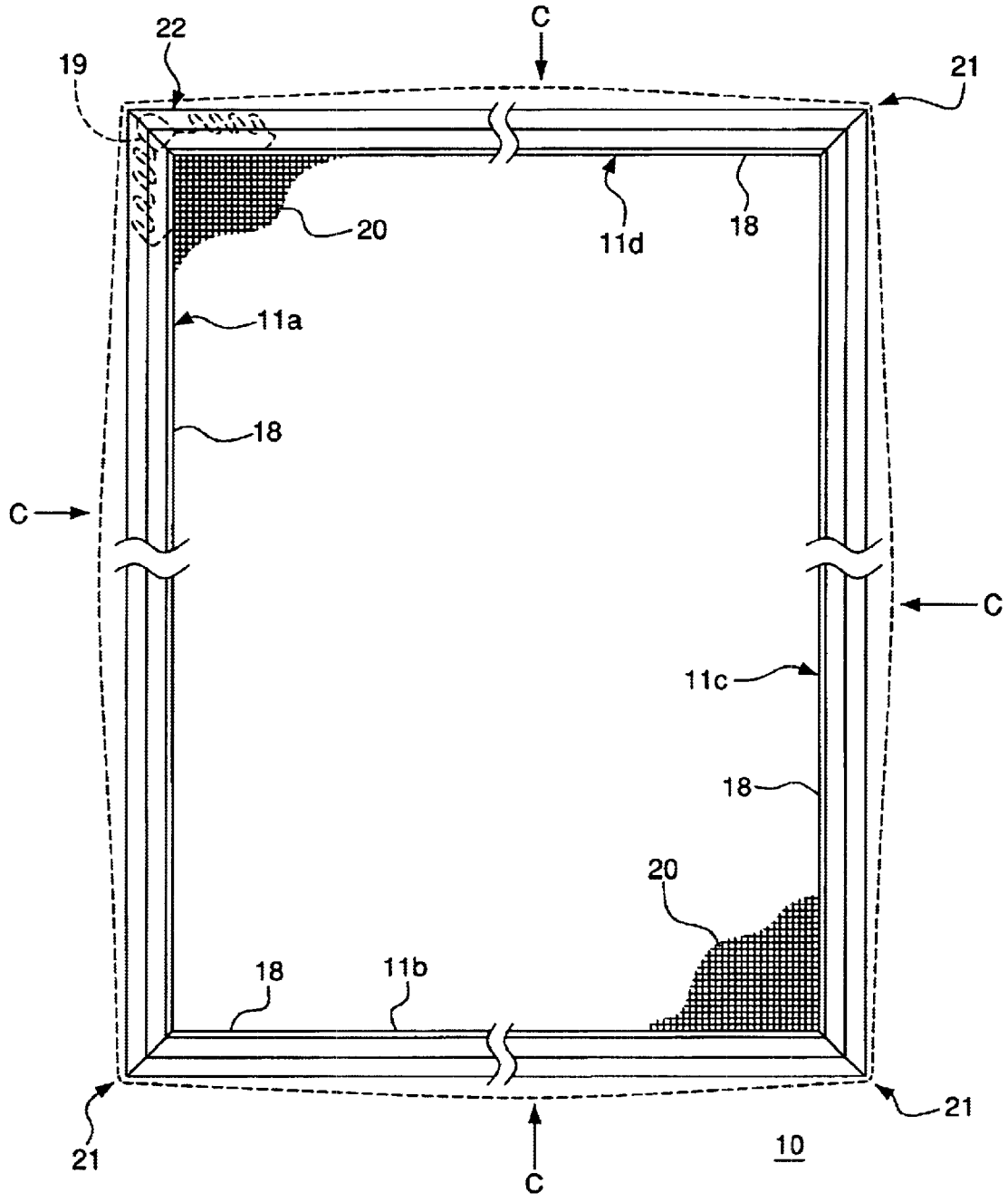
FIG. 4 is a plan view of the completed screen frame assembly formed from the body of FIG. 1.

FIG. 4 shows an exemplary embodiment of a screen frame assembly 10 according to the present invention. The exemplary assembly includes a hollow body 11 (screen bar) (which may be made of metal) having a mounting surface 16 for receiving ventilation screen material 20. Details of an exemplary screen bar material, and methods and apparatus for attaching screen cloth 20 to the mounting surface 16 of the body (screen bar) 11 are included in the above-identified patent applications that are incorporated by reference. Other screen bar materials, such as solid screen bar, or foam filled screen bar may also be used. Alternatively, the frame fabrication techniques described below may be used in conjunction with a spline type screen cloth insertion technique to form a complete screen-frame assembly.

Figure 1:
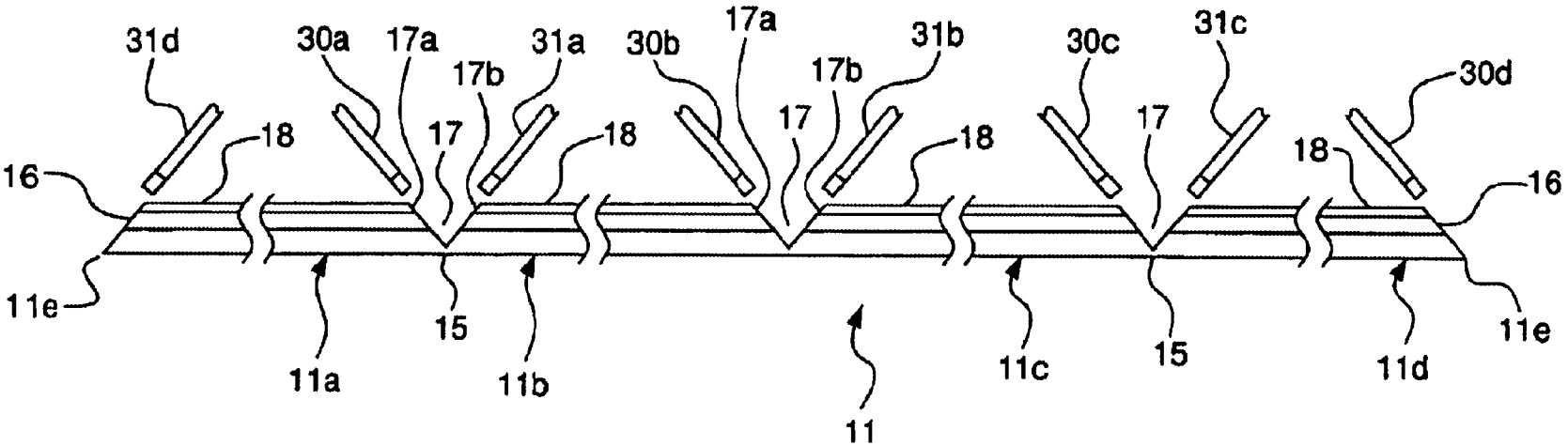
FIG. 1 is a side elevation view of an exemplary screen bar being formed by an exemplary embodiment of a method according to the invention.

The exemplary body 11 has at least three V-shaped cuts 17 (shown in FIG. 1) partially through the body. Each V-shaped cut 17 leaves an edge 15 of the body 11 uncut. The body 11 is folded about each uncut edge 15 (shown in FIG. 3) so that the ends 11*e* of the body meet at a corner 22. Each V-shaped cut 17 subtends an angle θ that is slightly less than 90 degrees, so that the folded corners 21 are in compression. In the exemplary embodiment, each V-shaped cut 17 subtends an angle of about 89 degrees. The ends 11*e* of the body 11 are joined into a closed frame, using a corner key 19 or other suitable joining means. Key 19 may be made of conventional materials, including metal or polymers.

Figure 3:
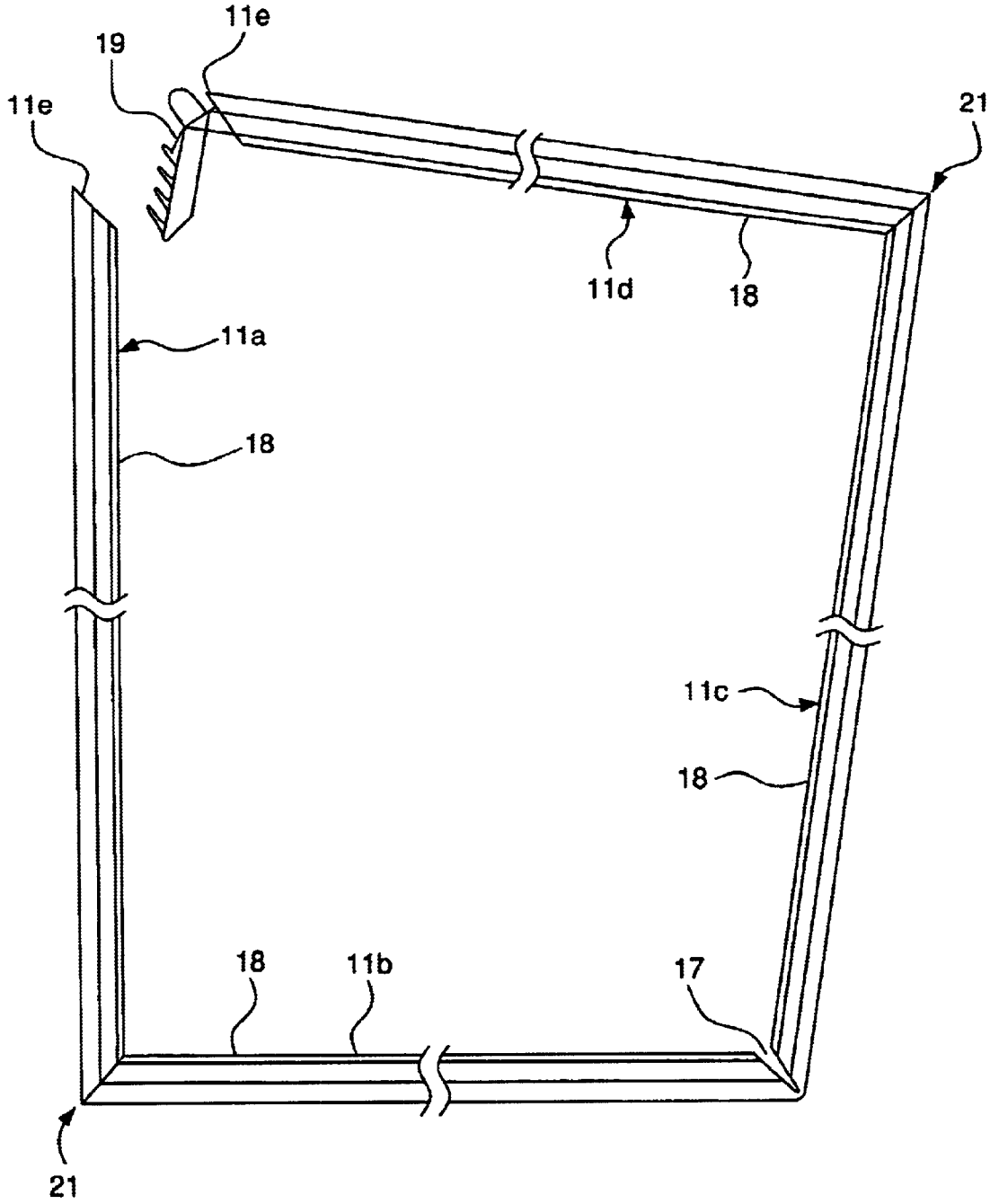
FIG. 3 is a plan view of the screen bar of FIG. 1, folded to form a frame.

Although the frame of FIG. 3 has three V-shaped cuts 17 and a corner key 19, a rectangular frame may also be formed by using a body (not shown) with four V-shaped cuts, wherein the ends of the body do not meet at a corner. The body is folded at four corners, into a rectangular frame. One side of the frame comprises the two ends of the body, each of which may be half the length of the opposite side of the frame. The ends do not have to have the same length, so long as the total of the lengths of the ends is equal or slightly less than the length of the side of the frame opposite the side formed by the ends. For a joining means, a straight key is used to join the ends of the body together. The straight key may fit inside each end of the body. The straight key may be completely internal (preferred), or it may have a small shoulder separating the ends of the body.

Reference is now made to FIG. 4. FIG. 4 shows a completed frame assembled from the body of FIG. 3. Another aspect of the exemplary embodiment is the use of a pre-bowed screen bar stock 11. The body 11 has a convex curvature with a radius of curvature of about 50 meters while the body 11 is in an unstressed state. The curvature is shown in exaggerated form by the dashed lines on the outer perimeter of the frame 11 in FIG. 4, for better visibility. Immediately after folding, the sides 11*a*–11*d* of the frame have a convex curvature, indicated by the dashed lines in FIG. 4. The sides 11*a*–11*d* of the frame are deformed inward by compressive forces C, so that each side is substantially straight. A ventilation screen cloth 20 is mounted to each side of the frame 11*a*–11*d*. The sides 11*a*–11*d* of the frame are released, so that tension in the frame 11*a*–11*d* maintains tension in the screen cloth 20. The use of the pre-bowed screen bar stock 11, and methods and apparatus for straightening the screen bar while attaching the screen cloth 20 are set forth in the above-referenced patent applications that are incorporated by reference.

Figure 2:
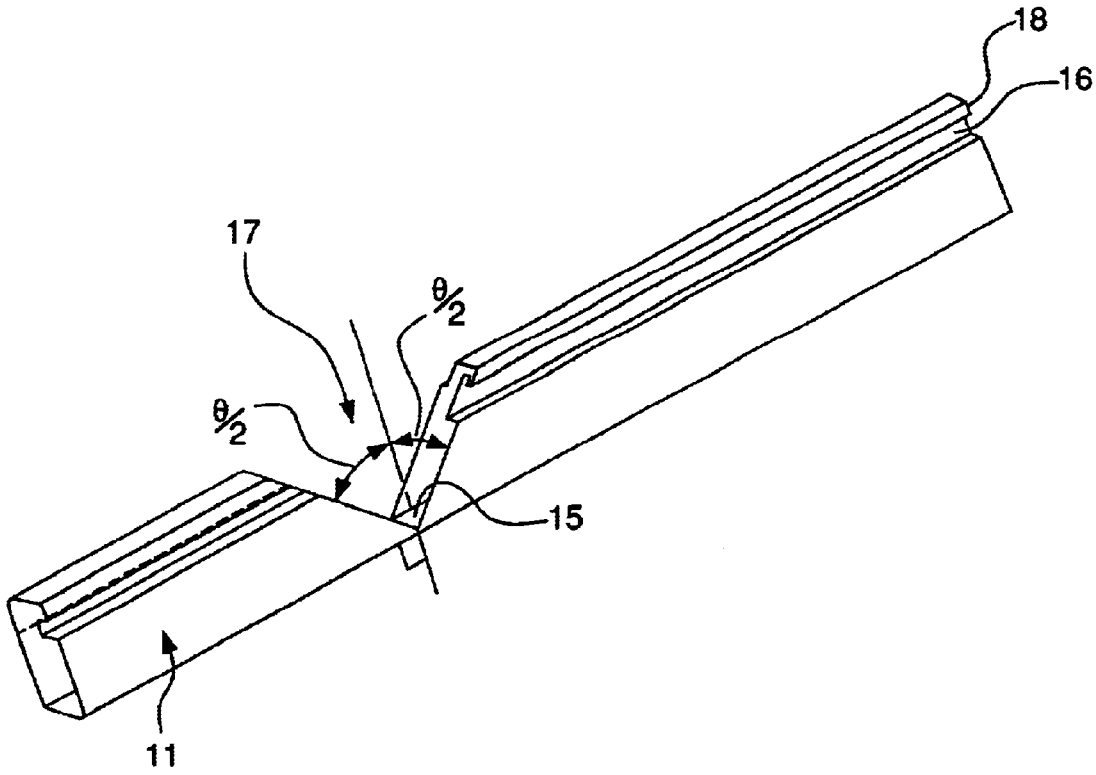
FIG. 2 is an isometric view of a portion of the screen bar of FIG. 1.

One exemplary embodiment is a screen frame corner 21 made from a closed hollow profile structure (i.e. "boxframe") 11, manufactured by rollforming, or extruding metal (aluminum or steel, for instance), or plastic/composite. The corner 21 is made by making a miter cut 17 having a total angle θ, wherein the outside of the corner web member 15 of the box frame 11 is left intact (i.e. not cut). Furthermore, the miter cuts 17 are made at slightly less than one half the total corner angle (i.e. for right angled corners, the cuts are each made at an angle (θ/2) slightly less than the standard 45 degrees (approximately 44.5 degrees each—see FIG. 2)), for a total miter angle of θ=89 degrees. This results in the mating mitered faces 11*a*–11*d* being put under compressive load when the sides are folded. Without being bound by any theory of the operation of this effect, the inventor believes that the resultant compressive load creates frictional resistance that stiffens and strengthens the corner. The integral outer web 15 of the corner allows for this compressive load to be applied and thus avoids the slack associated with corner keys 19 in three of the four corners. Also the outer continuous web 15 gives continuity of load carrying capacity at the corner joint.

Figure 9:
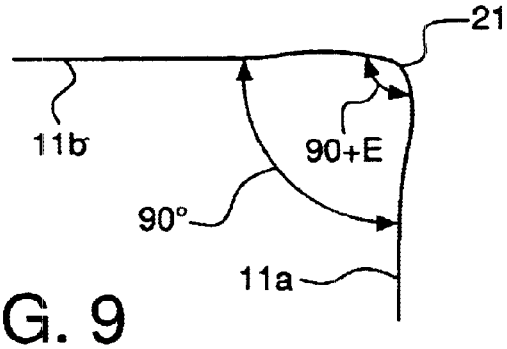
FIG. 9 is a diagram showing deformation of the frame of FIG. 4 very close to the corner.

FIG. 9 is an exaggerated view of an angle of a folded corner 21 formed between two sides 11*a* and 11*b* of the exemplary frame of FIG. 4, after completion of the screen frame assembly 10. Only the centerline of each side of the screen bar 11*a*, 11*b* is shown, for simplicity. The overall frame 11 is rectangular, and the angle between any two adjacent sides (measured far from the corner 21) is 90 degrees. However, very close to the corner, the sides 11*a*, 11*b* are deformed slightly to an angle of 90+ϵ, where ϵ is greater than zero and less than the amount of the undercut. The undercut is the difference between the nominal angle between frame sides and the angle of the cut 17. For example, if the frame sides 11*a*, 11*b* are nominally 90 degrees apart, and the angle of cut 17 is 89 degrees, then the undercut is one degree, and ϵ is between zero and one degree. The local deformation of each side very close to the corner 21 has an S-shape, as shown. In practice, this deformation is very slight and not visually noticeable to the unaided eye.

Another exemplary embodiment is a boxframe rollformed steel or aluminum screen frame assembly 10 (FIG. 4) wherein at least one (preferably all or all but one) of the corners of a polygonal screen frame are made in the manner described in the preceding paragraph. Typically, the final corner 22 is fitted with a corner key 19 in the conventional way.

Another exemplary embodiment takes advantage of the pre-bow in the screen bar material as an additional or alternative method of placing the folded corners 21 of the frame in compression. In describing this embodiment, reference is again made to FIG. 4. A ventilation screen-frame assembly 10 comprises a hollow body 11 having a mounting surface 16 for receiving ventilation screen material 20. The body has one or more V-shaped cuts 17 partially therethrough. In this embodiment, there are three V-shaped cuts, which may subtend an angle of 90 degrees for a rectangular screen or 45 degrees for an octagonal screen. Each V-shaped cut 17 leaves an edge 15 of the body uncut. The body 11 is folded about each uncut edges 15 so that the ends 11*e* of the body meet at a corner 22. The body has a radius of curvature of about 50 meters while the body is in an unstressed state. Means are provided for joining the ends of the body into a closed frame. The joining means may be as described elsewhere herein. Ventilation screen cloth 20 is tensioned by and mounted to the frame, so that the sides of the frame are held substantially straight by the screen cloth, and the body is in compression at each folded corner.

The ventilation material may even be blocked to tension the frame so that the sides have a very small negative (i.e., concave) bow, which is still substantially straight, but sufficient to impart a desired compression in the folded corners of the frame. Preferably, any such negative bow has a radius of curvature greater than 50 meters. That is, the curvature of the negative bow is preferably smaller in magnitude than the curvature of the convex pre-bow prior to tensioning the screen cloth, because visible hourglassing of the frame is undesirable. A small amount of compression at the folded corners can improve the strength and stiffness of the frame.

Preferred Method of Making Screen Frame

The screen bar 11 is rollformed or extruded in the conventional way to create a segment length of screen bar. The bar 11 is cut to the desired final length, equaling the final perimeter length with a miter cut 17 on each end 11*e* of the screen bar segment length (45-degree miter for a rectangular screen) to receive a conventional internal corner key 19.

This cutting is either made on a longer piece 11, thus trimming the piece to length, or, preferably, by cutting the bar 11 to length as it is being made (rollformed only) without trimming, to avoid waste and formation of scrap material.

On a typical rectangular screen frame by the present method, the three internal corners 21 are made by cutting two miter cuts 17*a* and 17*b* (i.e. one miter cut pair 17) per corner 21 on the screen bar segment 11, whereby the cuts are made at slightly less than half the overall corner angle (i.e., two 44.5 degree cuts for a 90 degree corner), and the outer web member 15 is left intact on the corner 21. Alternatively, as noted above, all of the corners may be formed using the mitered cuts, with the ends of the screen bar joined by a straight key to form a side of the frame. The distance between the miter cut pairs 17 is equal to the desired length or width dimension of the sides. Preferably, all miter cuts are made simultaneously (i.e. 8 saw cuts using 8 blades 30*a*–30*d* and 31*a*–31*d* for a four sided frame), but the cuts 17*a*, 17*b* could also be made sequentially, in groups or as individual cuts, by either indexing the saw(s) or the work piece (i.e. screen bar segment).

Preferably, the miter cuts 17*a* and 17*b* are made off line of the rollformer (not shown) or extruder (not shown) on a pre-cut-to-length lineal screen bar segment. Alternatively, if rollformed, the cuts can made on-line with the rollformer as the rollformer indexes or advances the screen bar segment accordingly. This indexing requires very accurate position and speed control. Also, indexing requires speed ramping, which may slow the cutting process.

The internal corners 21 produced in the above manner were found to be stronger and stiffer than corners made in the conventional way using either internal miter cut keys 19, screw fasteners, or straight cut plastic keys. When frames were made with exactly 45 degree miter cuts (as opposed to 44.5 degree cuts) with the outer webs left intact, the resultant strength was functionally acceptable, but the strength and stiffness were less than achieved with the 44.5 degree cuts. When the miter cuts 17 were made at less than half the total angle, the mechanical properties were improved as shown in Table 1.

TABLE 1

| | Side Loading (Lbs./inch Displacement) | Torsional Loading (Lbs./inch Displacement) |
|---|---|---|
| Folded (3 folded corners) | 2.65 | 0.45 |
| Folded with L-shaped reinforcement clip (3 folded corners) | 3.85 | 0.55 |
| Internal Miter Cut Keys (4 corners) | 2.47 | 0.36 |
| Straight Cut Plastic Keys (4 corners) | 0.57 | 0.3 |

No reinforcement 40 was required, as the strength and stiffness were noticeably higher than conventional screen frames. The strong and stiff structure is created when the frame 11 is folded together. The internal corners 21 with the less-than-45-degree miters 17 and integral outer webs 15 put the entire frame 11 in a stressed condition when the final corner key 19 is inserted. Although the entire frame 11*a*–11*d* is in a stressed condition, there is a concentration of compressive stress in the corners 21 (load over the mating faces of the screen bar walls). This loaded condition allows some side loading (i.e. external couple loading applied in the plane of the frame assembly) and torsional loading (external couple loading applied perpendicular to the plane of the frame) to be applied, without the mating surfaces (of the particular corners that are being pulled apart) separating. Also, strong reaction forces are available at the particular corners that are being further compressed, thus providing a high specific strength and high specific stiffness.

Another feature of the exemplary embodiment is that the geometry of screen bar 11 allows for the stressed corner design to work as described above. Specifically, the formed spline/adhesive groove portion 16 of the bar his multiple and adjacent folds (e.g., on the lip 18) that provide increased surface area for assured mating. Also, the fact that these folds are inherently spaced apart from the intact web member 15 allows for significant compressive loading without localized buckling on the light gauge material. If, for example, the same technique were applied to a simple rectangular tube with similar overall dimensions and wall thickness (i.e. without the spline/adhesive groove 16), mating the surfaces would be much more difficult; the compressive, load capacity much less; and, the frictional resistance would not be as great.

Alternative Method of Manufacture

The miter cut 17 results can be achieved by stamping or pre-notching the flat strip (from which body 11 is formed) upstream and just prior to rollforming. This may be done on-line and the strip may be accumulated in a loop between the notching station and the rollformer. This allows for the notching operation to be done without the need to stop and start the rollformer, flying cut-off saws or off-line saws. An encoder length-measuring wheel may be used to control the location of the corner notches.

Corner Reinforcement

Although the frame assembly 10 described above is structurally stronger and stiffer than conventional corner keyed assemblies, additional reinforcement is possible and may be desired. Two potential means of reinforcement are described below:

I) L-Shaped Channel Reinforcement Clip

Figure 5:
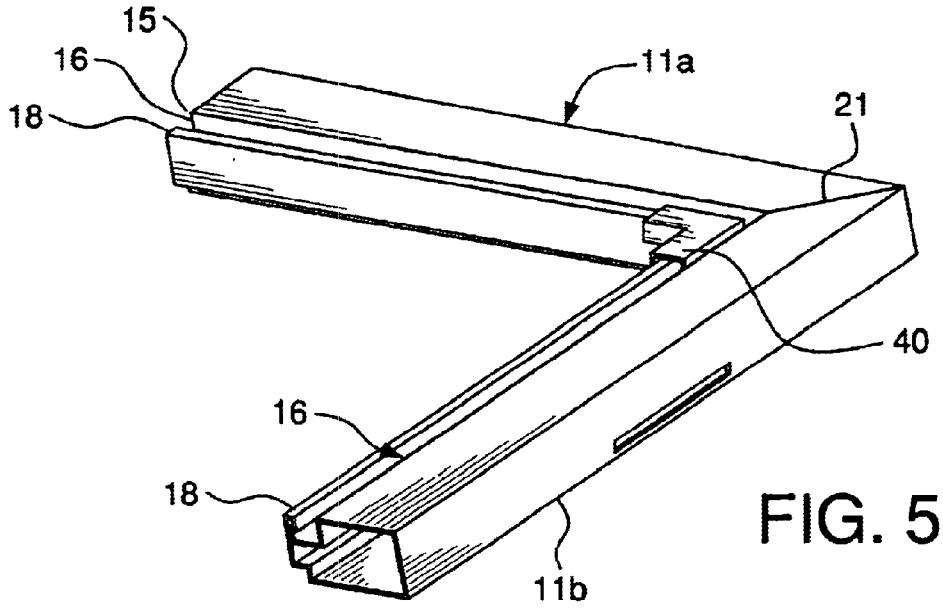
FIG. 5 is an isometric view of a mitered corner of the frame of FIG. 4, with a reinforcement therein.
Figure 6:
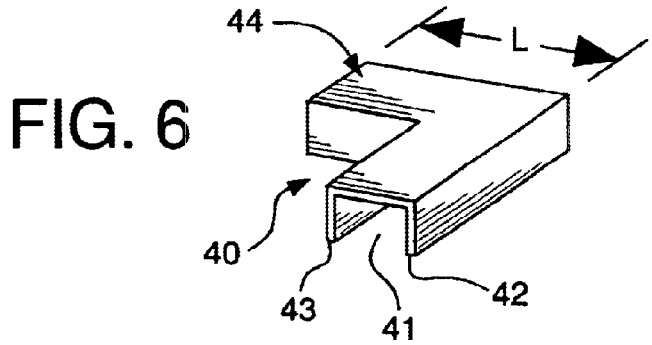
FIG. 6 is a detailed view of the reinforcement of FIG. 5.

FIG. 5 shows a corner 21 having reinforcement clip 40 thereon, and FIG. 6 is a detailed isometric view of the reinforcement clip. The preferred reinforcement 40 consists of an outer wall 42 and an inner wall 43 joined by a web 44 to form an L-shaped channel 41. Each leg of the reinforcement 40 has a length L of approximately 1.27 cm (½") long with a U-channel profile with a wall of approximately 0.038 cm (0.015") to 0.15 cm (0.060") thick. A preferred thickness is 0.1 cm (0.040"). The reinforcement clip 40 is secured (snap fit or crimped, for example) over the lip or walls 18 of the spline groove 16 (or tensioning step for adhesively mounting the screen 20 to the screen bar 11) that forms a corresponding L-shape in the corner 21. This reinforcement technique is preferred for adhesively mounted screens, but may be difficult to use when spline is used, as the outer channel walls 42 interfere with the spline insertion. This reinforcement 40 is easy to apply (particularly for adhesively mounted screen cloth) and provides significant strength and stiffness to the corners 21, and thus to the entire frame assembly 10. Reinforcement 40 essentially stops the cut corner faces 17*a* and 17*b* from separating when a load couple is applied, and thus increases the load carrying capacity to the corner 21 and whole frame assembly 10. It allows for a reduction in metal gauge of body 11 below what is conventionally used while still providing acceptable mechanical properties.

II) Internal Key

A key that frictionally inserts into the internal miter cuts was tried and offered some degree of corner reinforcement. To achieve this, a corner key 19 for conventional miter cut corners was modified (i.e. shortened in both directions) to fit into the internal corners 21 with the integral outer web member 15. This type of reinforcement increases the torsional strength and stiffness of the corner significantly, but offered little or no improvement to side loading.

Automation of Screen Frame Assembly Fabrication

International Patent Application No. PCT/IB00/01716 (Publication No. WO01/14682 A2) and U.S. Provisional Patent Application No. 60/272,334 describe a method in which screen cloth is fastened to a frame using hot melt glue. The glue can be inserted into the groove 16 on the front face of the screen bar material continuously during roll forming. The screen bar material is cut to length and the screen bar cools. If the frame is assembled with plastic corner keys, it is not practical to keep the frame at elevated temperatures for a prolonged period of time, because plastic deformation of the keys occurs. Instead, the glue is cooled, and the corner keys are inserted to assemble the frame. To prepare the screen frame for insertion of screen cloth into the glue, the entire frame is re-heated in an oven for a brief period, re-melting the glue without melting or deforming the corner keys.

However, when fabricating the folded corner screen frame assembly 10 described above, plastic corner keys can be eliminated (An internal metal key 19 may be used for the one corner 22 joining ends 11*e* or for the straight key used to join the ends if all of the corners are of the folded type). Because the corners 21 of frame 11 do not require conventional plastic corner keys, there is no concern with melting the corners. Thus, the glue can be maintained at a sufficiently hot temperature (e.g., between about 110° C. and 120° C.) to keep the glue melted throughout the frame fabrication process. The frame 11 can be mounted on the screen insertion apparatus directly after the roll forming, glue insertion and cutting operations are completed, without cooling the frame. The screen cloth 20 is then inserted into the glue. Because the cooling step is eliminated, the subsequent re-heating step is also eliminated. This reduces the fabrication cycle time. Also, the screen insertion facility is simplified, because a re-heating oven is not required.

Figure 7:
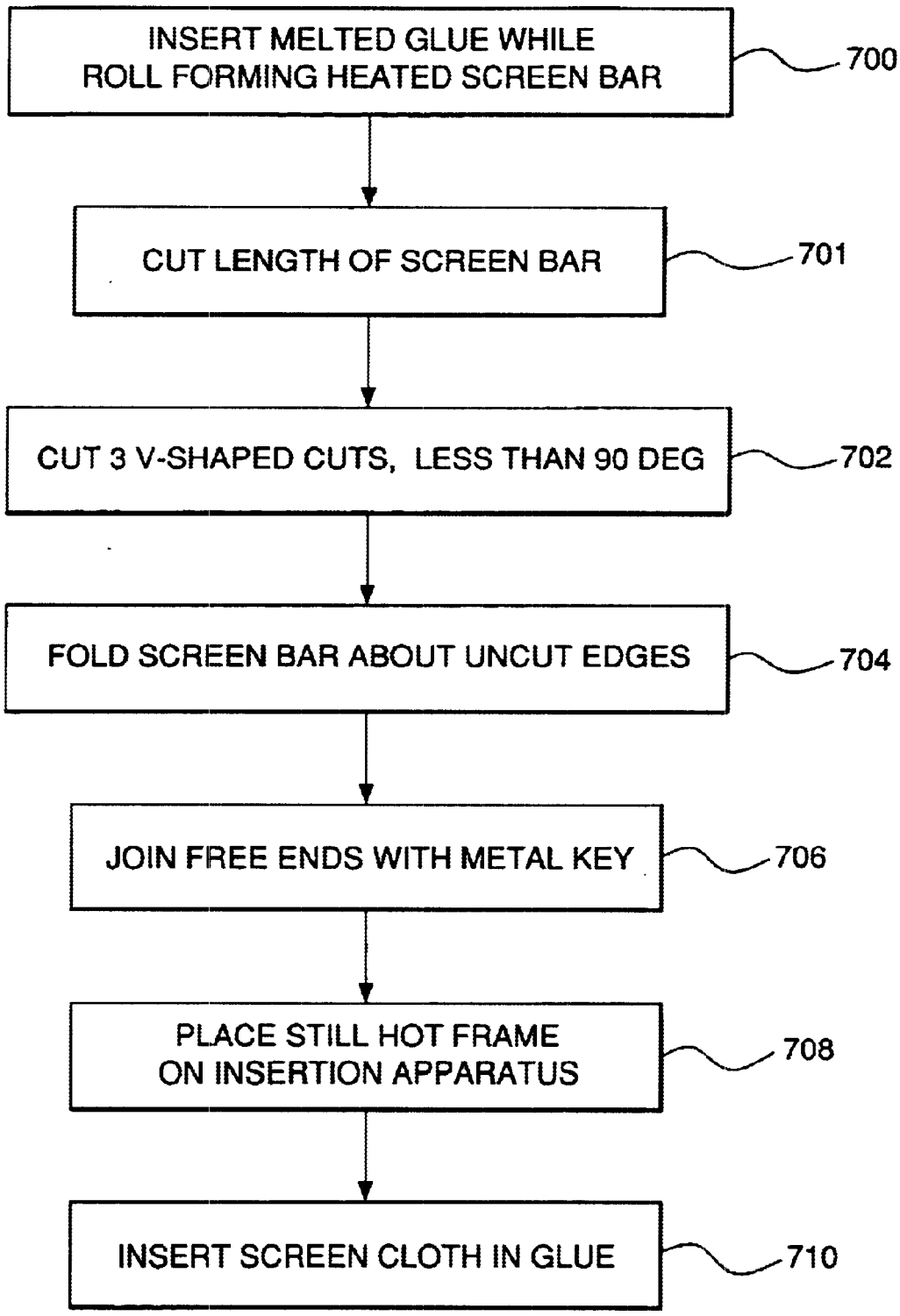
FIG. 7 is a flow chart diagram of a method of fabricating a screen using the frame of FIG. 3.

FIG. 7 shows an exemplary method, which can be performed continuously. At step 700, the hot melt glue is inserted into the groove while roll forming the screen bar material (or alternatively, immediately after roll forming). The line speed can be controlled so that one length of screen bar is formed during the fabrication cycle of a screen frame assembly. At step 701, the length of screen bar required for one frame is cut. At step 702, three V-shaped cuts 17 are made in the screen bar 11. Preferably, the V-shaped cuts 17 are slightly less than 90 degrees, as described above (although it is contemplated that the automated technique can also be used for a frame having a 90 degree cut). At step 704, the screen bar 11 is folded about the three uncut edges 15 of the screen bar section. At step 706, the free ends 11*e* of the screen bar 11 are joined with a metal key 19. At step 708, the frame is transferred directly to the insertion apparatus (which may be of a type shown in WO01/14682 A2), without cooling the frame between the roll forming operation and mounting the frame on the insertion apparatus. At step 710, the screen cloth 20 is inserted in the frame 11.

Although the exemplary embodiment includes a screen and frame assembly having four sides, one of ordinary skill can apply the structures and techniques described above to any polygonal screen and frame assembly having three or more sides. For example, for an equilateral. frame with fewer or more than four sides, each V-shaped cut subtends an angle θ defined by the equation:

$$\theta = \left(\frac{N-1}{N+1} * 180\right) - \delta,$$

wherein θ is even in degrees, N is the number of V-shaped cuts, and δ is a small differential relative to $$\left(\frac{N-1}{N+1}\right) * 180,$$

so that the folded corners are in compression. In an exemplary embodiment, δ is 1 degree. Alternatively, δ may be determined by the equation:

$$\delta \approx 0.01 * \left(\frac{N-1}{N+1}\right) * 180.$$

One of ordinary skill recognizes that it is also possible to apply the structures and methods described above to non-equilateral polygonal frames. In such a frame, the sides are not all of the same length; therefore the angles are not all the same either. For any given angle in a frame, the method may be practiced by determining the angles between each consecutive pair of sides and reducing the angle of each cut by either about 1 degree or about 1% when the grooves 17 are formed, thereby to achieve the desired compression.

Figure 8:
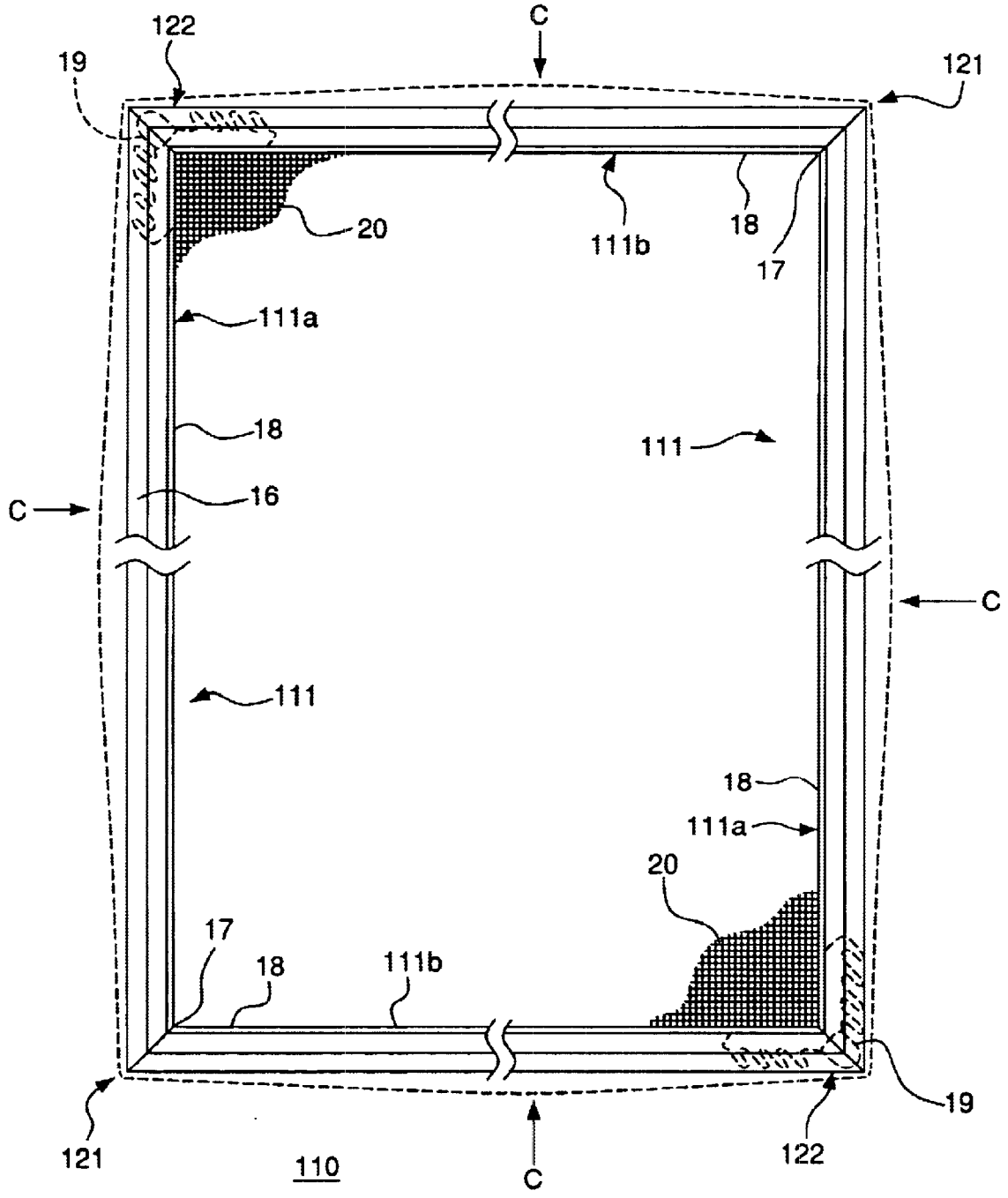
FIG. 8 is a plan view of a second exemplary embodiment.

FIG. 8 shows another exemplary embodiment of a frame for a ventilation screen-frame assembly 110. Unless indicated otherwise, items having the same reference numeral as the embodiment of FIG. 4 are the same, and a detailed description thereof is not repeated. Assembly 110 includes a pair of elongate hollow bodies 111, each having a mounting surface 16 for receiving ventilation screen material 20. (Solid or filled bodies may also be used). Each body 111 has a V-shaped cut 17 partially therethrough. Each V-shaped cut 17 leaves an edge of the body 111 uncut. The bodies 111 are folded about each uncut edge so that each V-shaped cut 17 subtends an angle θ that is slightly less than 90 degrees, and the folded corners 121 are in compression. The two bodies 111 are arranged so as to form a four sided-frame with the ends of the bodies 111 meeting at corners 122 of the bodies. Means are provided for joining the ends of the bodies into a closed frame. The exemplary joining means are a pair of corner keys 19.

One of ordinary skill can readily construct an alternative frame having one folded corner and three corner keys, using techniques as described above.

Although the invention has been described in terms of exemplary embodiments, it is not limited thereto. Rather, the appended claim should be construed broadly, to include other variants and embodiments of the invention, which may be made by those skilled in the art without departing from the scope and range of equivalents of the invention.

What is claimed is:

1. A corner for a ventilation screen-frame, comprising:

a body having a mounting surface for receiving ventilation screen material, said body having a V-shaped cut partially therethrough, the V-shaped cut leaving an edge of the body uncut, said body being folded by a fold angle about the uncut edge, the V-shaped cut subtending a cut angle that is slightly less than the fold angle, so that the folded corner is in compression.

2. The corner of claim 1, wherein the cut angle is about 1 degree less than the fold angle.

3. A frame for a ventilation screen-frame assembly, comprising:

a body having a mounting surface for receiving ventilation screen material, said body having one or more V-shaped cuts partially therethrough, each V-shaped cut leaving an edge of the body uncut, said body folded about each uncut edge so that the ends of the body meet, each V-shaped cut subtending an angle θ that is slightly less than 90 degrees, so that the folded corners are in compression; and means for joining the ends of the body into a closed frame.

4. The frame of claim 3, wherein each V-shaped cut subtends an angle of about 89 degrees.

5. The frame of claim 3, wherein the body has a radius of curvature of about 50 meters while the body is in an unstressed state.

6. The frame of claim 3, further comprising at least one reinforcement that fits onto a portion of a respective corner of the frame.

7. The frame of claim 6, wherein the body has a groove and a lip adjacent thereto, and the reinforcement is an L-shaped channel member that fits over the lip on two contiguous sides of the frame.

8. The frame of claim 6, wherein the body has a groove and a lip adjacent thereto, and the reinforcement is an L-shaped channel member that fits over the lip on two contiguous sides of the frame.

9. A frame for a ventilation screen-frame assembly, comprising:

a body having a mounting surface for receiving ventilation screen material, said body having a plurality of V-shaped cuts partially therethrough, each V-shaped cut leaving an edge of the body uncut, said body folded about each uncut edge so that the ends of the body meet at a corner, each V-shaped cut subtending an angle θ defined by the equation:

$$\theta = \left(\frac{N-1}{N+1} * 180\right) - \delta,$$

wherein θ is given in degrees, N is the number of V-shaped cuts, and δ is a small differential relative to $$\left(\frac{N-1}{N+1}\right) * 180,$$

so that the folded corners are in compression; and means for joining the ends of the body into a closed frame.

10. The frame of claim 9, wherein δ is given by the equation:

$$\delta \approx 0.01 * \left(\frac{N-1}{N+1}\right) * 180.$$

11. The frame of claim 9, wherein N is three, and θ is approximately one degree.

12. The frame of claim 9, wherein the body has a radius of curvature of about 50 meters while the body is in an unstressed state.

13. The frame of claim 9, wherein the joining means is a corner key.

14. A ventilation screen-frame assembly, comprising:

a body having a mounting surface for receiving ventilation screen material, said body having at least three V-shaped cuts partially therethrough, each V-shaped cut leaving an edge of the body uncut, said body folded about each uncut edge so that the ends of the body meet, each V-shaped cut subtending an angle θ that is slightly less than 90 degrees, so that the folded corners are in compression;

means for joining the ends of the body into a closed frame; and ventilation screen cloth, tensioned by and mounted to the frame.

15. The assembly of claim 14, wherein each V-shaped cut subtends an angle of about 89 degrees.

16. The frame of claim 14, wherein the body has a radius of curvature of about 50 meters while the body is in an unstressed state, and the sides of the frame are held substantially straight by the screen cloth.

17. The frame of claim 14, further comprising at least one reinforcement that fits onto a portion of a respective corner of the frame.

18. The frame of claim 17, wherein the body has a groove and a lip adjacent thereto, and the reinforcement is an L-shaped channel member that fits over the lip on two contiguous sides of the frame.

19. A method for forming a frame for a ventilation screen-frame assembly, comprising the steps of:

providing a body having a mounting surface for receiving ventilation screen material, cutting at least three V-shaped cuts partially through the body, each V-shaped cut leaving an edge of the body uncut, each V-shaped cut subtending an angle θ that is slightly less than 90 degrees;

folding said body about each uncut edge so that the ends of the body meet, so that the folded corners are in compression; and joining the ends of the body to form a closed frame.

20. The method of claim 19, wherein each V-shaped cut subtends an angle of about 89 degrees.

21. The method of claim 19, wherein the body has a radius of curvature of about 50 meters while the body is in an unstressed state.

22. The method of claim 21, further comprising the steps of:

bending the sides of the frame inward so that each side is substantially straight;

mounting a ventilation screen cloth to each side of the frame; and releasing the sides of the frame, so that tension in the frame maintains tension in the screen cloth.

23. A method for forming a ventilation screen-frame assembly, comprising the steps of:

forming a body having a mounting surface for receiving ventilation screen material;

heating the body;

inserting a hot melt adhesive in a groove of the body;

cutting at least three V-shaped cuts partially through the body, each V-shaped cut leaving an edge of the body uncut;

folding said body about each uncut edge so that the ends of the body meet;

joining the ends of the body to form a closed frame;

transferring the frame directly to an insertion apparatus without cooling the frame; and inserting screen cloth into the hot melt adhesive.

24. The method of claim 23, wherein the adhesive is inserted during a roll forming step.

25. The method of claim 23, wherein the joining step includes inserting a metal key in both ends of the body.

26. The frame of claim 25, wherein the body has a radius of curvature of about 50 meters while the body is in an unstressed state.

27. The frame of claim 25, further comprising at least one reinforcement that fits onto a portion of a respective corner of the frame.

28. A frame for a ventilation screen-frame assembly, comprising:

a pair of elongate bodies, each having a mounting surface for receiving ventilation screen material, each body having a V-shaped cut partially therethrough, each V-shaped cut leaving an edge of the body uncut, said bodies folded about each uncut edge so that each V-shaped cut subtends an angle θ that is slightly less than 90 degrees and the folded corners are in compression, the two bodies arranged so as to form a four sided frame with the ends of the bodies meeting at corners of the bodies; and means for joining the ends of the bodies into a closed frame.

29. The frame of claim 28, wherein each V-shaped cut subtends an angle of about 89 degrees.

30. A ventilation screen-frame assembly, comprising:

a body having a mounting surface for receiving ventilation screen material, said body having at least one V-shaped cut partially therethrough, each V-shaped cut leaving an edge of the body uncut, said body folded about each uncut edge so that the ends of the body meet, wherein the body has a radius of curvature of about 50 meters while the body is in an unstressed state;

means for joining the ends of the body into a closed frame and ventilation screen cloth, tensioned by and mounted to the frame, so that the sides of the frame are held substantially straight by the screen cloth, and the body is in compression at each folded corner.

31. The frame of claim 30, further comprising at least one reinforcement that fits onto a portion of a respective corner of the frame.

32. The frame of claim 31, wherein the body has a groove and a lip adjacent thereto, and the reinforcement is an L-shaped channel member that fits over the lip on two contiguous sides of the frame.

* * * * *